US009157627B2

(12) United States Patent
Wu

(10) Patent No.: US 9,157,627 B2
(45) Date of Patent: Oct. 13, 2015

(54) MODULAR LED LAMP STRUCTURE WITH REPLACEABLE MODULES AND RAPID MAINTENANCE

(71) Applicant: Ming-Yuan Wu, Tiapei (TW)

(72) Inventor: Ming-Yuan Wu, Tiapei (TW)

( * ) Notice: Subject to any disclaimer, the term of this patent is extended or adjusted under 35 U.S.C. 154(b) by 258 days.

(21) Appl. No.: 13/841,542

(22) Filed: Mar. 15, 2013

(65) Prior Publication Data

US 2014/0204584 A1 Jul. 24, 2014

(30) Foreign Application Priority Data

Jan. 24, 2013 (TW) ..... 102102693 A

(51) Int. Cl.
*F21V 29/00* (2015.01)
*F21K 99/00* (2010.01)
*F21V 29/74* (2015.01)

(52) U.S. Cl.
CPC ..... *F21V 29/2206* (2013.01); *F21K 9/1355* (2013.01); *F21V 29/74* (2015.01)

(58) Field of Classification Search
CPC ..... F21K 9/13; F21V 7/02; F21V 7/105; F21V 23/003; F21V 29/20; F21V 19/0001; F21V 19/0035; F21V 19/0005
USPC ..... 362/294, 373, 647; 313/46
See application file for complete search history.

(56) References Cited

U.S. PATENT DOCUMENTS

2011/0121704 A1* 5/2011 Wang et al. ..... 313/46
2013/0051034 A1* 2/2013 Hashimoto ..... 362/373

* cited by examiner

*Primary Examiner* — Karabi Guharay

(57) ABSTRACT

A modular LED lamp structure includes a light emitting module, a driver module and a heat dissipating element. The heat dissipating element is utilized to reduce a working temperature of the LED lamp. The light emitting module is disposed on the heat dissipating element and connected electrically to the driver module. The driver module is detachably disposed in the heat dissipating element. The light source element is detachable and may be replaced to other lamp with different types. Therefore, the maintenance cost of the LED lamp is reduced. Also, the modules can be replaced without having to discard the whole set of LED lamp. Thus the unnecessary waste is eliminated to achieve cost-effectiveness and environment protection.

11 Claims, 10 Drawing Sheets

MODULAR LED LAMP STRUCTURE WITH REPLACEABLE MODULES AND RAPID MAINTENANCE

BACKGROUND OF THE INVENTION

1. Field of Invention

The present invention relates to a LED lamp, in particular to a LED lamp structure used for the purpose of illumination with replaceable modules in achieving cost-effectiveness and environment protection.

2. Related Art

As a solid state light source, LEDs (light-emitting diodes) are a product with long life span, firm structure, low power consumption and flexible dimension such that they are becoming to take the place of conventional high pressure halide lamps in a wide range of lighting applications. However, LEDs would generate comparatively high heat energy, with a result of their high light fades and shortened life span. This leads to limited applications of LEDs to some extent.

A currently available LED lamp, which is used for the purpose of illumination, usually comprises a plurality of LED light sources to form a LED array in order to reach the required illuminance and power, because a single one LED light source has relatively low illuminance and power. The LED array structure may satisfy the requirement for illuminance, but it causes several problems including heat concentration, and high temperature at local positions. Because of the absence of specialized means for heat conduction and heat dissipation, the heat energy generated by the plurality of LED light sources cannot be effectively dissipated, such that the temperature of the housing of the lamp is so high to the extent that people would get scalded and that this lamp is vulnerable to get burned out.

The conventional LED lighting device lacks the flexibility of assembling and is not economical. Furthermore, when parts of the LED lamp is in failure and needs replacement, it can not replace the failure part only and has to replace the entire LED lamp. In other words, the other non-failure parts are also replaced as well as the failure parts at the same time, which is in causing unnecessary waste.

SUMMARY OF THE INVENTION

The present invention overcomes the above-described and other problems and disadvantages in the prior art by providing a LED lamp with simplified structure to mass-produce easily with cost down and to enable rapid repair and maintenance.

A major objective of the present invention is to provide a modular LED lamp, wherein, the modules, such as a light emitting module, or a driver module, can be replaced when they break down, without having to discard the whole set of LED lamp, thus eliminating the unnecessary waste, in achieving cost-effectiveness and environment protection.

Accordingly, the present invention provides a LED lamp includes a heat dissipating holder, a light emitting module and a driver module. The light emitting module is disposed on a front end of the heat dissipating holder. The driver module is detachably disposed in the heat dissipating holder and electrically connected to the light emitting module. Therefore, the rapid repair and maintenance is permitted. Also, the light emitting module and the driver module are changeable when they break down, without having to discard the whole set of LED lamp, thus eliminating the unnecessary waste, in achieving cost-effectiveness and environment protection.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 3:
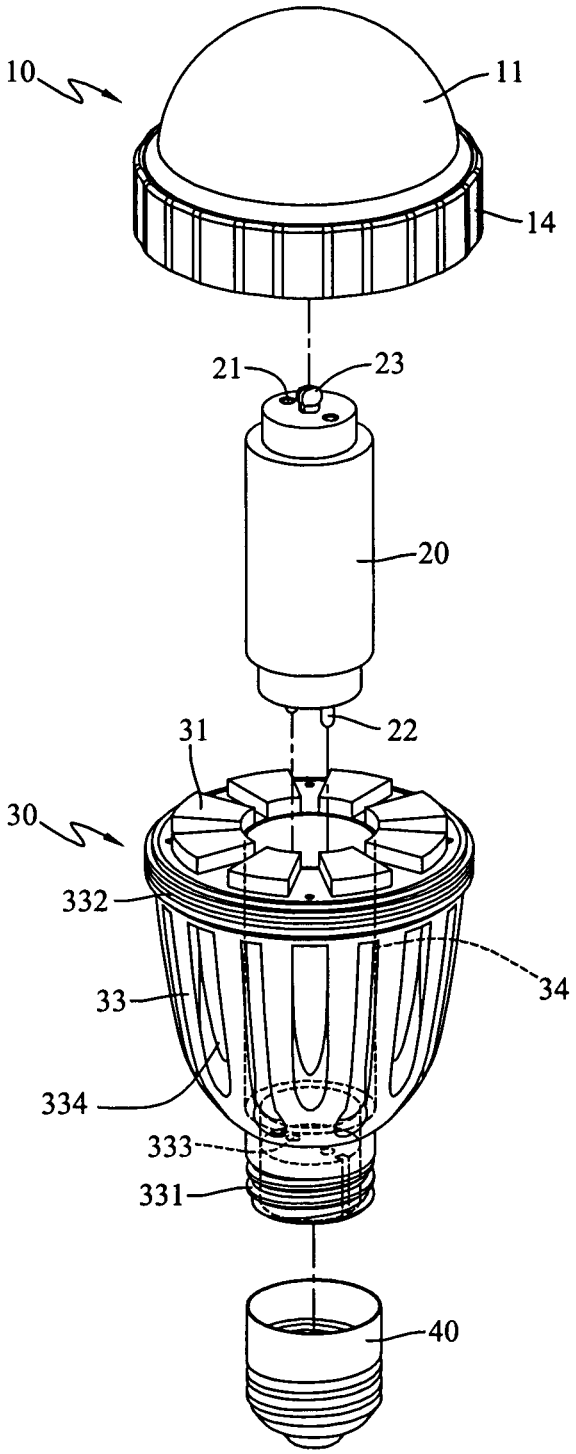
FIGS. 3 and 4 are perspective views of a LED lamp structure of a first preferred embodiment of the present invention.
Figure 4:
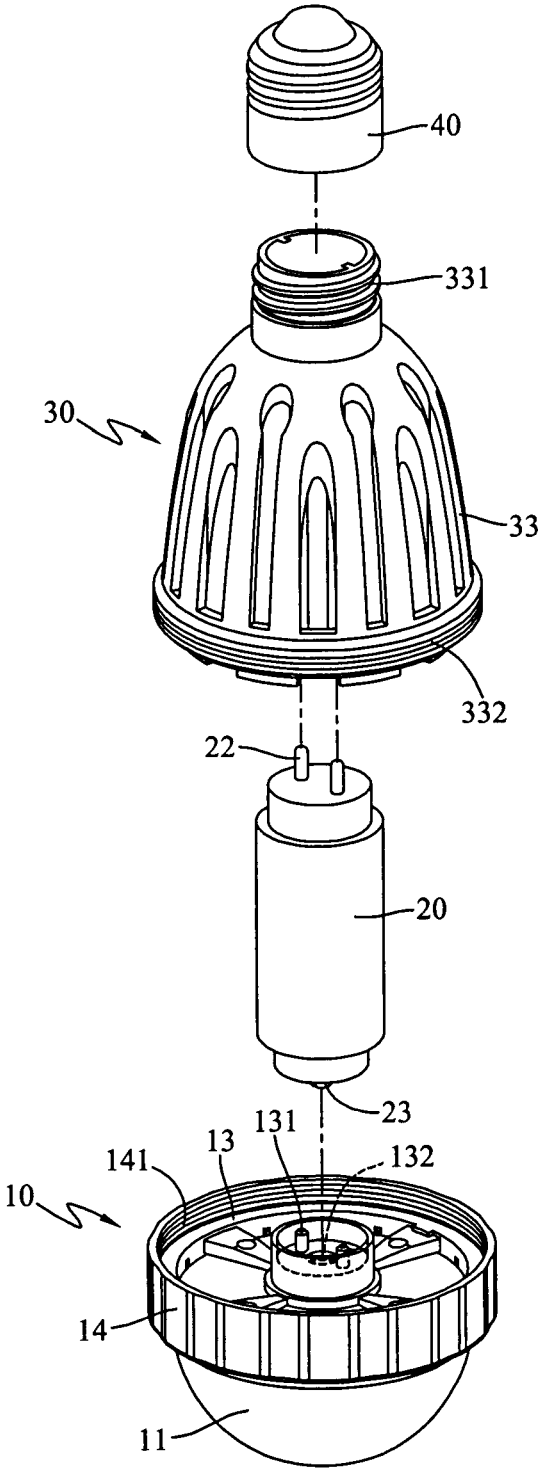
Figure 5:
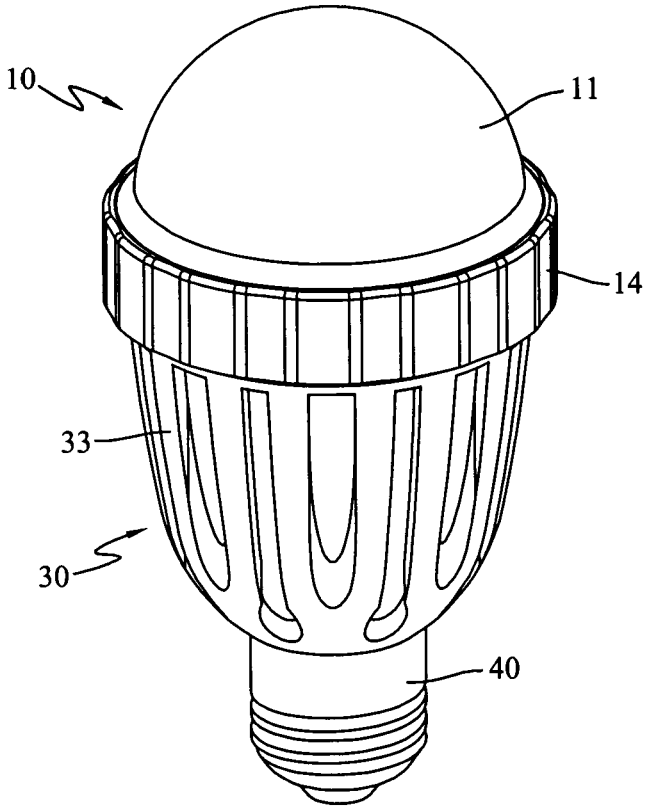
FIG. 5 is a schematic views of a LED lamp structure of a first preferred embodiment of the present invention.

A LED lamp structure of a first embodiment of the present invention is shown in FIGS. 3 and 4. The LED lamp includes a heat dissipating holder 30, a light emitting module 10 and a driver module 20. The light emitting module 10 is disposed on a front end 31 of the heat dissipating holder 30. The driver module 20 is detachably disposed in the heat dissipating holder 30 and electrically connected to the light emitting module 10. The driver module 20 is configured to receive input power from an AC power source such as a commercial power source or from a DC power source such as a battery, to convert the input power into required DC power, and output the required DC power to the light emitting module 10. The driver module 20 may also be adapted to control or regulate the total current for the light emitting module 10, please also refer to FIG. 5.

The driver module 20 includes a fastening pillar 23 for detachably connection to a fixing hole 132 of the light emitting module 10. The light emitting module 10 includes at least one contact pin 131 to electrically connect a contact hole 21 of the driver module 20. The driver module 20 further includes a contact pin 22 to electrically connect a contact hole 333 of a lamp base 40, which is detachably disposed on a bottom end 331 of the heat dissipating holder 30. The heat generated by the driver module 20 may be dissipated from the lamp base 40. The lamp base 40 may be detachable and changeable with different type of bases, such as screw-type or bi-pin type, etc. The driver module 20 is column shaped and the heat dissipating holder 30 has a cylinder shaped space 34. The driver module 20 may be disposed in the space 34.

Figure 1:
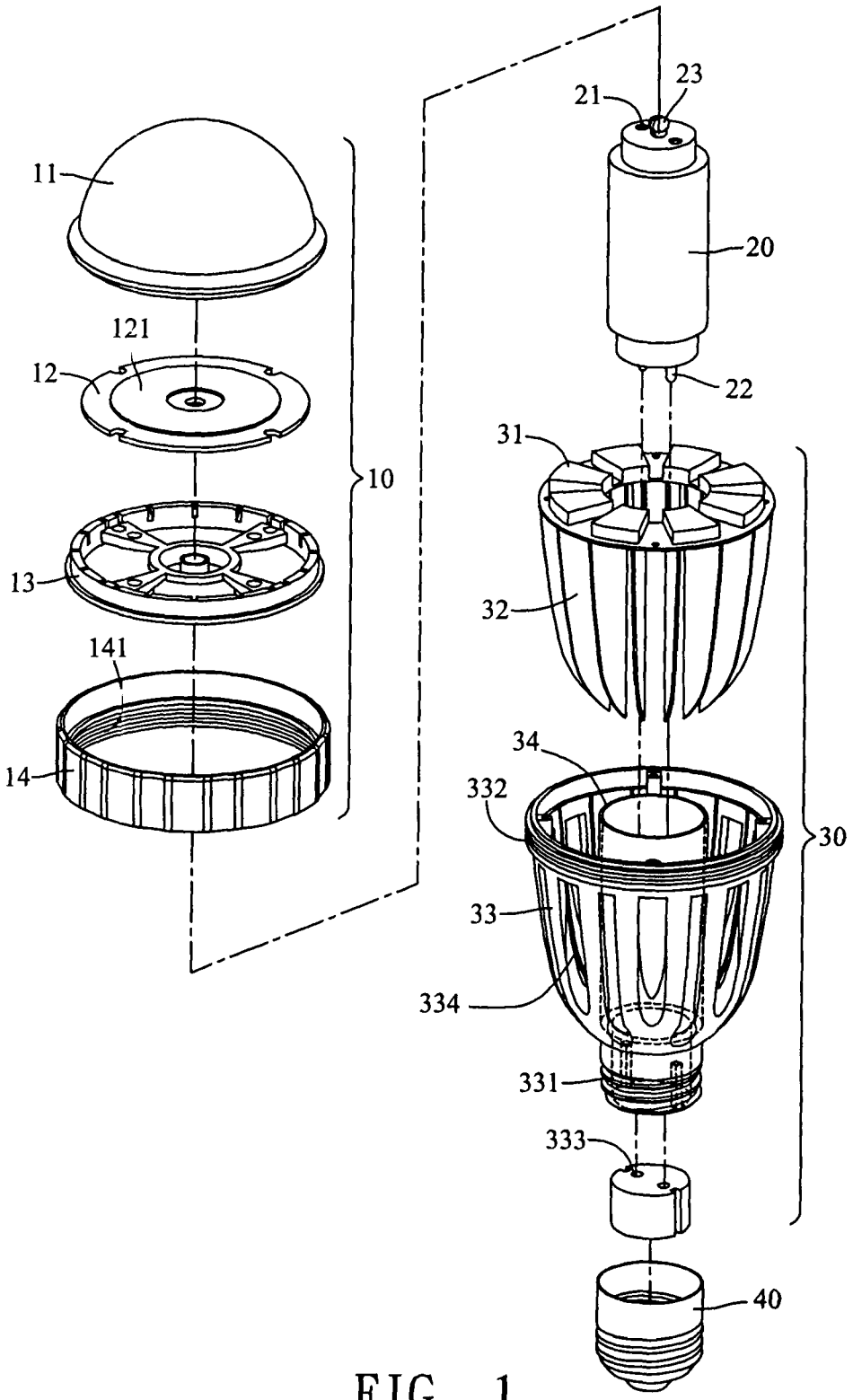
FIGS. 1 and 2 are explosive views of a LED lamp structure of a first preferred embodiment of the present invention.
Figure 2:
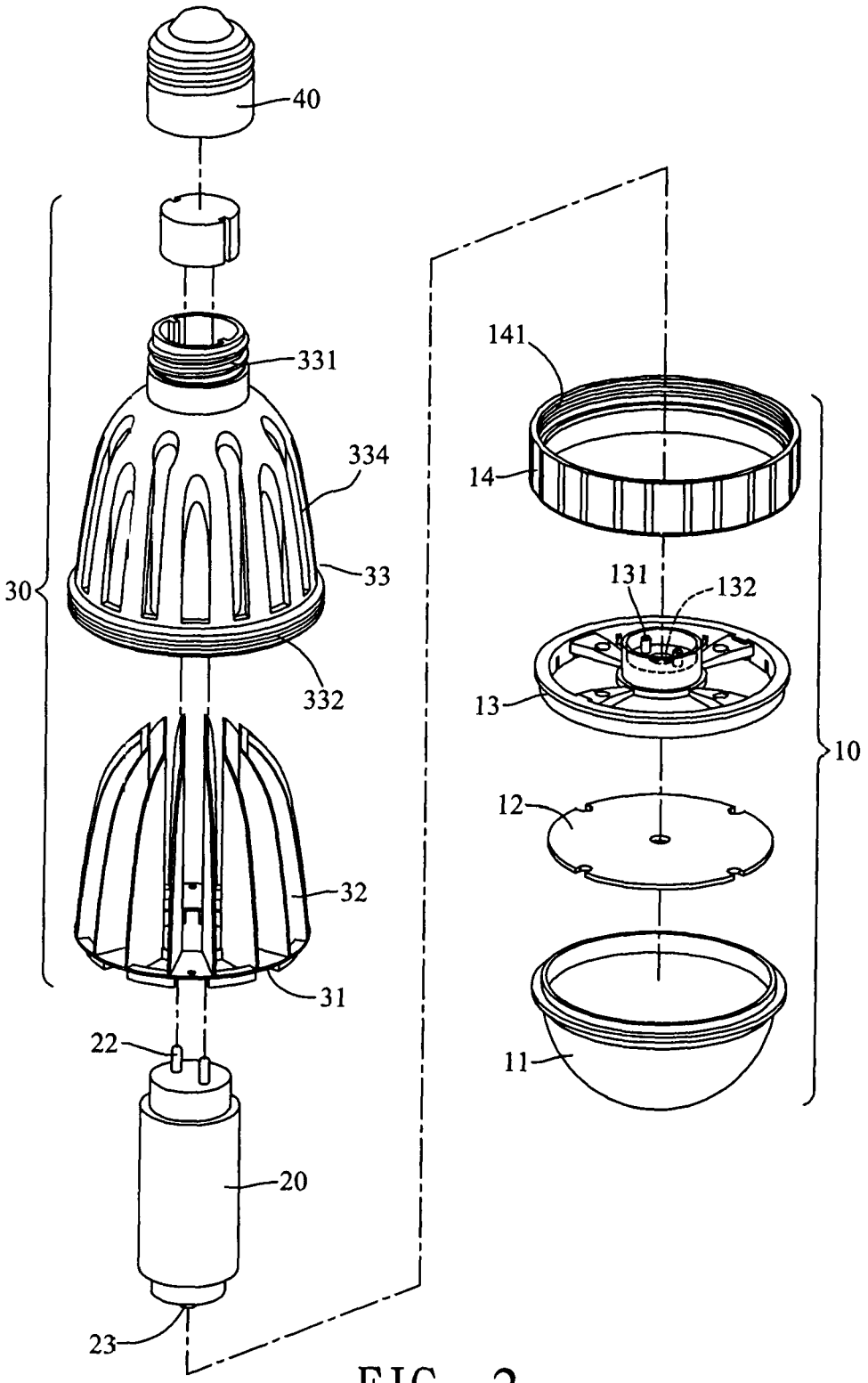

Please refer to FIGS. 1 and 2, the light emitting module 10 includes a body 13, a substrate 12, a lamp cover 11 and a connecting sleeve 14. The substrate 12 is supported by the body 13 and having a plurality of LEDs 121 disposed thereon and configured to emit lights. The LEDs 121 may be a surface mounting device (SMD) or have a chip on board (COB) package structure. The lamp cover 11 is disposed on the body 13 and covering the substrate 12 to protect the LEDs 121. The body 13 is disposed on and contacted to the front end 31 of the heat dissipating holder 30 for dissipating heat generated by the LEDs 121. The required DC power is transmitted to LEDs 121 of the light emitting module 10 through the contact pin 131 and the contact hole 21. The connecting sleeve 14 has an inner screw 141 and the heat dissipating holder 30 has an outer-screw 332 to engage together for connecting the light emitting module 10 to the heat dissipating holder 30. The lamp cover is a translucent cover to be penetrated by the light emitted by the LEDs 121.

Therefore, the driver module 20 and the light emitting module 10, such as the LEDs 121 of the substrate 12, can be replaced when they break down, without having to discard the whole set of the LED lamp. Thus, the unnecessary waste is eliminated to achieve cost-effectiveness and environment protection. On the other hand, the substrate 12 may has a reflective layer for raising luminous efficiency. And the body 13 may include a thermally conductive insulator.

The body 13 of the light emitting module 10 is disposed on the front end 31 of the heat dissipating holder 30 by magnetic attraction, and the heat dissipating holder 30 further includes a plurality of fins 32 extended inward from the top end 31. Also, the heat dissipating holder 30 further includes a housing 33 with a plurality of through holes 334 toward to the fins 32. The front end 31 and the fins 32 may be made of metal materials of high thermal conductivity such as copper and aluminum. A free convection of ambient air is allowed to dissipate a heat generated by the light emitting module 10. Therefore, the LED lamp can also have a prolonged service life and decreased light fade.

Figure 6:
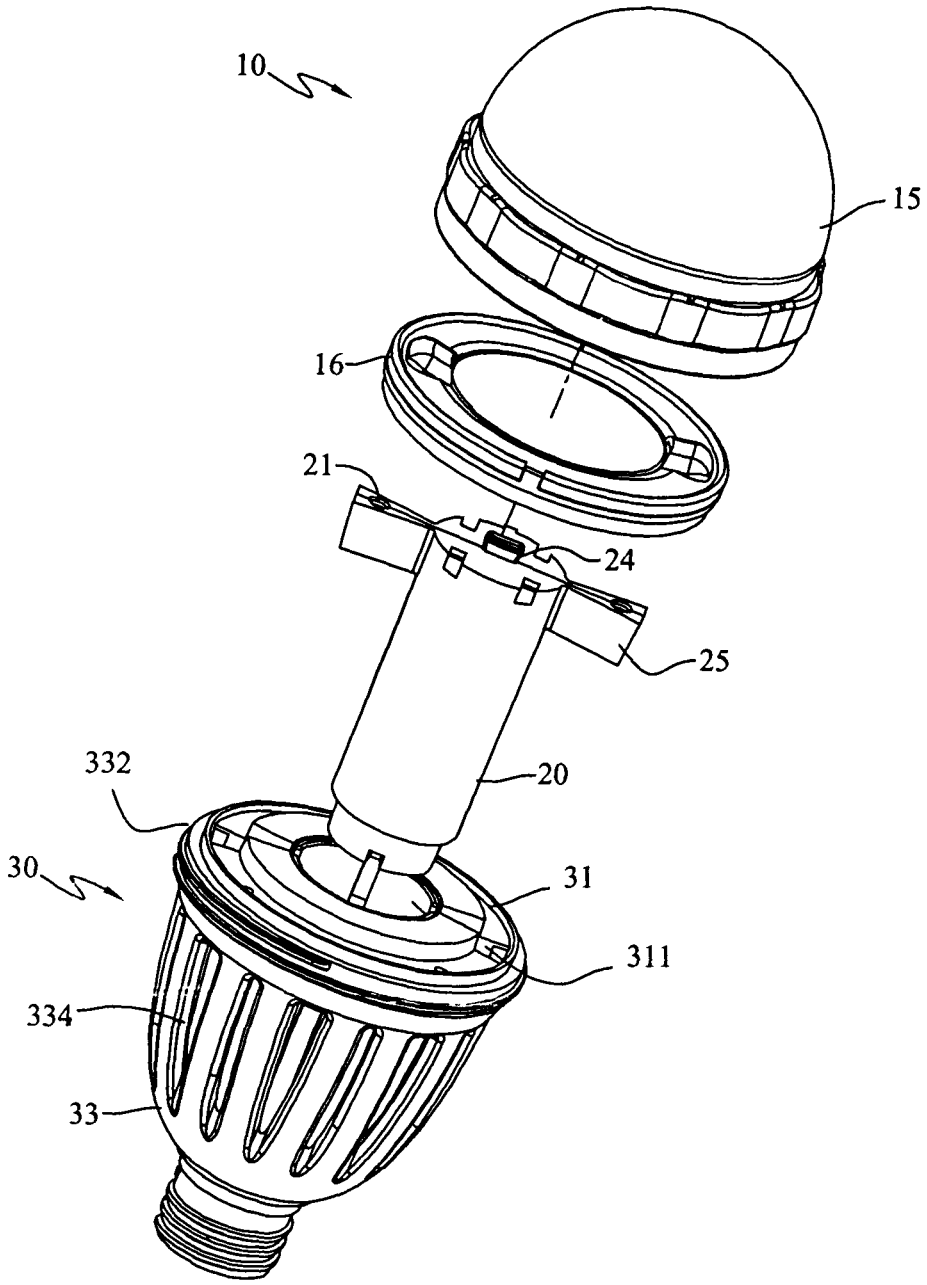
FIG. 6 is perspective view of a LED lamp structure of a second preferred embodiment of the present invention.

Please refer to FIG. 6, the light emitting module 10 may only include a light emitting plate 16 and a lamp cover 15, i.e. the body 13 and the substrate 12 of FIG. 1 are integrated into the light emitting plate 16. The light emitting plate 16 is disposed on the front end 31 of the heat dissipating holder 30 by magnetic attraction. The grip 24 is utilized to take off the driver module 20 from the heat dissipating holder 30. The driver module 20 further includes at least one protrusion 25 to dispose in a slot 311 of the heat dissipating holder 30 for positioning. Therefore, the light emitting plate 16 can be replaced when it breaks down only taking off the lamp cover 15.

Figure 7:
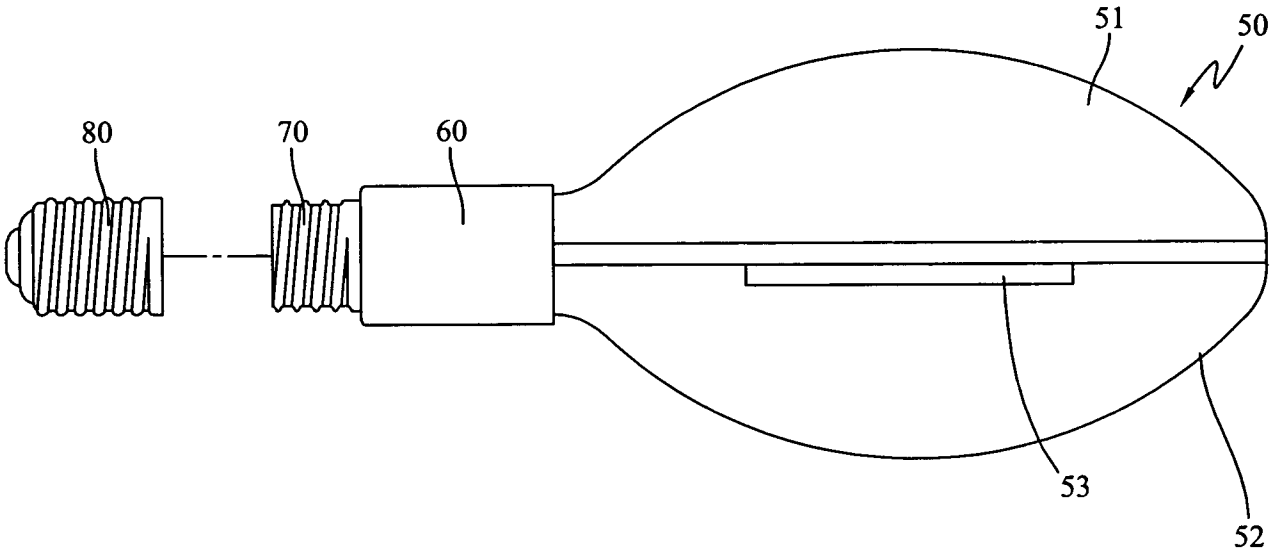
FIGS. 7, 8, 9 and 10 are perspective views of a high power LED lamp structure of another preferred embodiment of the present invention.

Please refer to FIG. 7, a high power LED lamp 50, such as street lamps, includes a heat dissipating holder 51, a light emitting plate 53 and a lamp cover 52. The upper half of the high power LED lamp 50 is the heat dissipating holder 51 and the lower half of the high power LED lamp 50 is the lamp cover 52. The light emitting plate 53 is disposed on the heat dissipating holder 51. The lamp cover 52 is disposed on the light emitting plate 53 and covers the light emitting plate 53 for protection, and connected to the heat dissipating holder 51. The driver module 60 is connected to a rear end of the heat dissipating holder 51. A lamp base 80 is detachably disposed on the driver module 60 by a connecting element 70.

Figure 8:
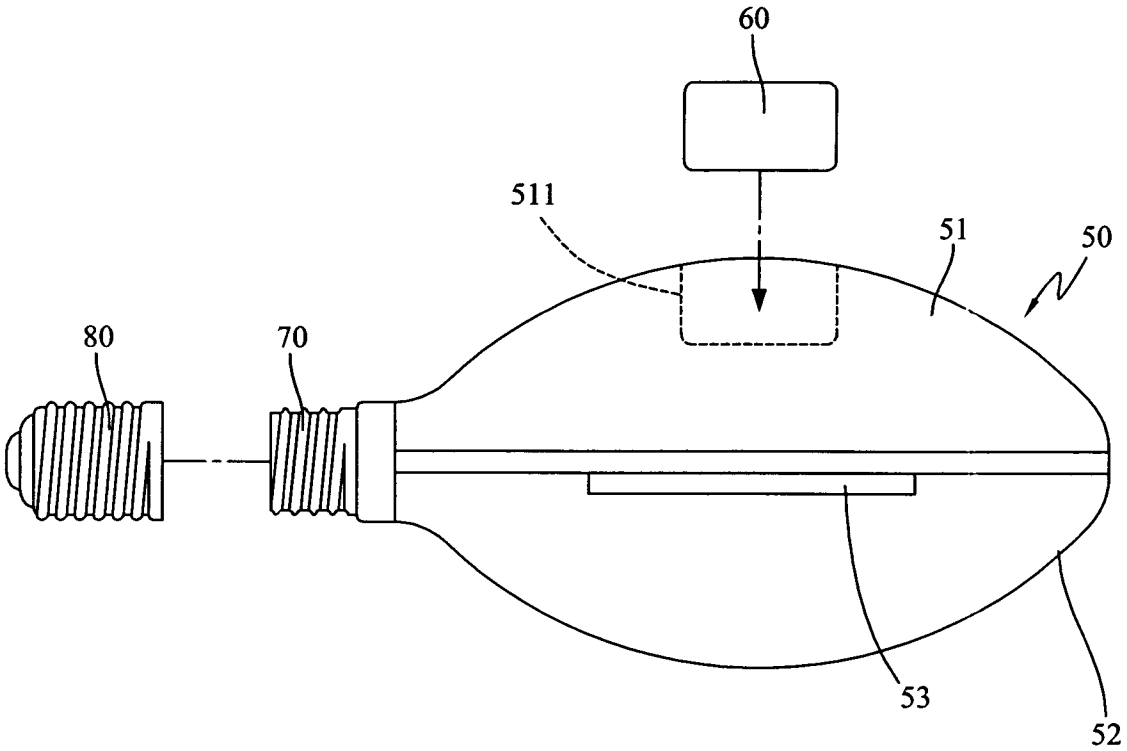
Figure 9:
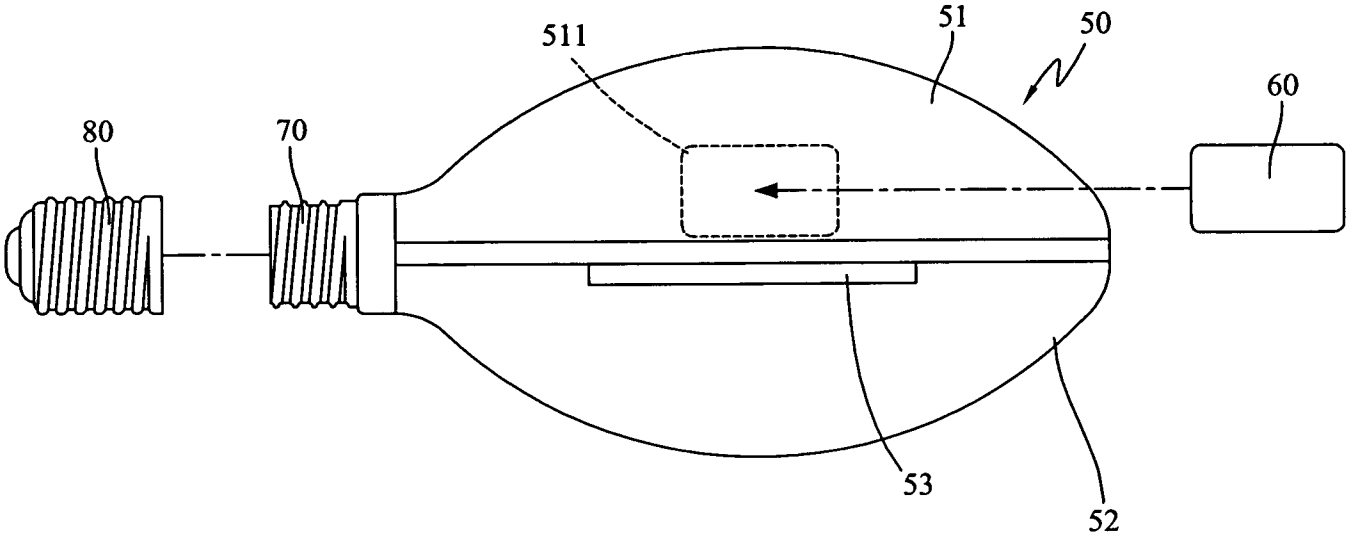
Figure 10:
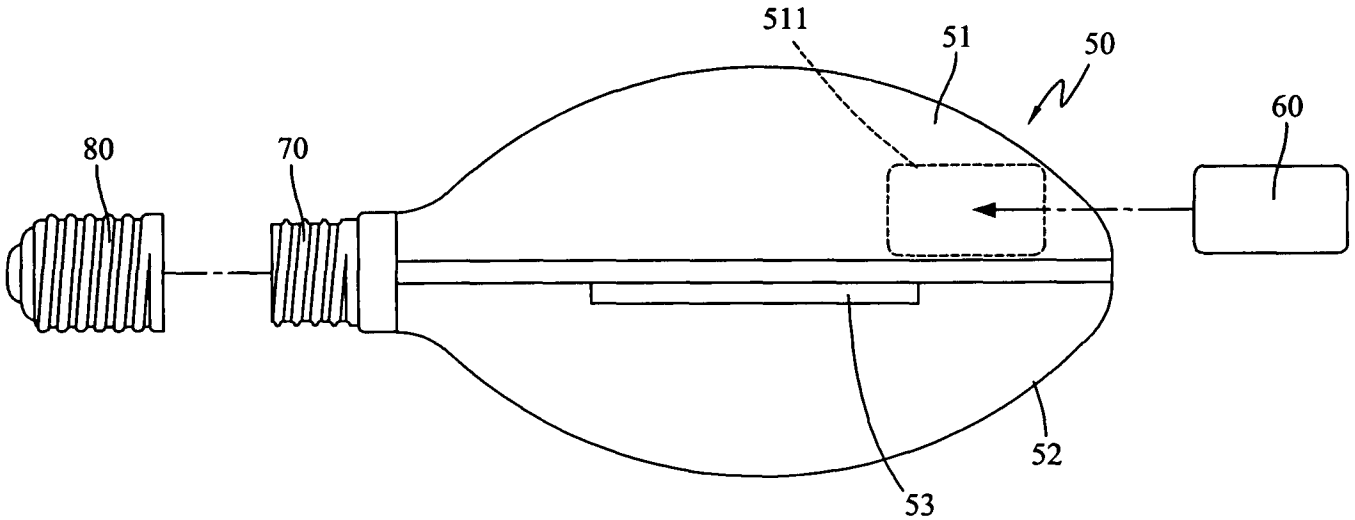

Please refer to FIGS. 8-10, the heat dissipating holder 51 has a containing space 511 to be disposed for the driver module 60. The containing space 511 may be located at the top of the heat dissipating holder 51, see FIG. 8, located on the side of heat dissipating holder 51, see FIG. 9, or at the front end of the heat dissipating holder 51, see FIG. 10.

The high power LED lamp 50 may add a plurality of the light emitting plates and the driver modules to increase illumination. The waterproof design may be used, such as a waterproof silicone or a waterproof washer to prevent the moisture to penetrate inside. Moreover the high power LED lamp of this invention may include a sucking disc mad of thermally conductive materials. The high power LED lamp may attach to the conventional street lights or mining lamps by the sucking disc.

Accordingly, the present invention provides a LED lamp structure with reduced maintenance cost and simplified maintenance process. The modular design of the LED lamp structure eases maintenance and tends to lower costs of maintenance as a failed light emitting module, or a driver module is easy to replace and is less expensive to replace than replacement of the entire lamp.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A LED lamp structure, comprising:

a heat dissipating holder;

a light emitting module, disposed on a front end of the heat dissipating holder and including at least one contact pin; and a driver module, as a modular element and detachably disposed in the heat dissipating holder, wherein the driver module includes a fastening pillar to physically connect to the light emitting module and at least one contact hole to receive the contact pin of the light emitting module for electrically connection.

2. The LED lamp structure of claim 1, wherein the driver module includes a contact pin to electrically connect a lamp base detachably disposed on a bottom end of the heat dissipating holder.

3. The LED lamp structure of claim 1, wherein the light emitting module comprising:

a body;

a substrate, supported by the body and having a plurality of LEDs disposed thereon; and a lamp cover, disposed on the body and covering the substrate to protect the LEDs.

4. The LED lamp structure of claim 3, wherein the body is disposed on and contacted to the front end of the heat dissipating holder for dissipating heat generated by the LEDs.

5. The LED lamp structure of claim 4, wherein the heat dissipating holder further includes a plurality of fins extended inward from the top end.

6. The LED lamp structure of claim 5, wherein the heat dissipating holder further includes a plurality of through holes toward to the fins.

7. The LED lamp structure of claim 4, wherein the body is disposed on the front end of the heat dissipating holder by magnetic attraction.

8. The LED lamp structure of claim 1, further comprising a connecting sleeve to connect the light emitting module to the heat dissipating holder.

9. The LED lamp structure of claim 1, wherein the light emitting module comprising:

a light emitting plate, electrically connected to the driver module; and a lamp cover, disposed on the light emitting plate and covering light emitting plate for protection, and connected to the front end of the heat dissipating holder.

10. The LED lamp structure of claim 9, wherein the light emitting plate is disposed on the front end of the heat dissipating holder by magnetic attraction.

11. The LED lamp structure of claim 1, wherein the driver module includes at least one protrusion to dispose in a slot of the heat dissipating holder for positioning.

* * * * *